US007946060B2

(12) United States Patent
Rosenbaum

(10) Patent No.: US 7,946,060 B2
(45) Date of Patent: May 24, 2011

(54) SHOE CHASSIS

(75) Inventor: Ori Rosenbaum, Laguna Beach, CA (US)

(73) Assignee: Auri Design Group, LLC, Laguna Beach, CA (US)

( * ) Notice: Subject to any disclaimer, the term of this patent is extended or adjusted under 35 U.S.C. 154(b) by 779 days.

(21) Appl. No.: 12/023,219

(22) Filed: Jan. 31, 2008

(65) Prior Publication Data

US 2009/0193682 A1 Aug. 6, 2009

(51) Int. Cl.
*A43B 13/12* (2006.01)
*A43B 13/14* (2006.01)

(52) U.S. Cl. ..... 36/30 R; 36/31; 36/28; 36/35 R; 36/35 B

(58) Field of Classification Search ..... 36/25 R, 36/31, 30 R, 28, 35 R, 37, 35 B, 102
See application file for complete search history.

(56) References Cited

U.S. PATENT DOCUMENTS 4,481,727 A 11/1984 Stubblefield
4,501,077 A 2/1985 Young
4,704,808 A * 11/1987 Bianchini et al. ..... 36/102
4,783,910 A * 11/1988 Boys et al. ..... 36/107
4,794,707 A * 1/1989 Franklin et al. ..... 36/107
5,070,629 A * 12/1991 Graham et al. ..... 36/27
5,077,915 A * 1/1992 Gross ..... 36/31
5,561,920 A * 10/1996 Graham et al. ..... 36/27
5,860,226 A * 1/1999 Graham et al. ..... 36/28
6,119,373 A 9/2000 Gebhard et al.
6,145,220 A * 11/2000 Johnson et al. ..... 36/34 R
6,199,303 B1 3/2001 Luthi et al.
6,321,469 B1 * 11/2001 Cretinon ..... 36/102
6,438,873 B1 8/2002 Gebhard et al.
6,446,359 B2 * 9/2002 Tomat ..... 36/3 R
6,477,791 B2 11/2002 Luthi et al.
6,497,058 B2 12/2002 Dietrich et al.
6,508,017 B1 * 1/2003 DeBarro et al. ..... 36/28
7,082,702 B2 8/2006 Cretinon
7,174,659 B2 2/2007 Delgorgue
7,299,567 B2 11/2007 Berend et al.
7,380,353 B2 * 6/2008 Feller et al. ..... 36/76 R
7,401,424 B2 7/2008 Kerns et al.
7,418,791 B2 9/2008 Cole, III
7,421,805 B2 9/2008 Geer
7,549,236 B2 6/2009 Dillon et al.
7,647,709 B2 1/2010 Reilly et al.
2003/0029059 A1 2/2003 Favreau et al.
2004/0098881 A1 5/2004 Flavio et al.
2005/0034328 A1 2/2005 Geer
2005/0178024 A1 8/2005 Hauglin
2007/0124960 A1 * 6/2007 Friedman ..... 36/30 R

* cited by examiner

*Primary Examiner* — Marie Patterson
(74) *Attorney, Agent, or Firm* — Snell & Wilmer L.L.P.

(57) ABSTRACT

The present invention relates to a shoe chassis. In one embodiment the present invention is a shoe chassis including a board with a first end and a second end, the board having a portion defining a first hole at the second end. The shoe chassis also includes a stabilizing unit beneath the board and a pod beneath the stabilizing unit. A flexible membrane is positioned within the first hole to allow the heel to flex past or through the first hole and compress a cushioning material located within the pod and positioned under the flexible membrane.

19 Claims, 1 Drawing Sheet

SHOE CHASSIS

BACKGROUND

1. Field

The present invention relates to a shoe chassis. More particularly, the present invention relates to a shoe chassis having a board with an opening and a flexible membrane positioned within the opening to allow the heel to flex past or through the opening and compress a cushioning material positioned under the flexible membrane.

2. Related Art

Many shoes have evolved to the point where they are used for aesthetic purposes. However, in developing shoes for aesthetic purposes, designers have often neglected two aspects of the shoe, comfort and functionality. Thus, while a pair of shoes may look stylish, they can often be cumbersome and painful to walk, jog, or run in. Therefore, there is a need for a shoe that is comfortable and functional allowing a user to move with ease.

SUMMARY

In one embodiment, the present invention is a shoe chassis including a board with a first end and a second end, the board having a portion defining a first hole at the second end. A flexible membrane may reside or be positioned within the first hole. The shoe chassis also includes a stabilizing unit beneath the board and a pod beneath the stabilizing unit. A cushioning material may be positioned below the flexible membrane.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

Figure 1:
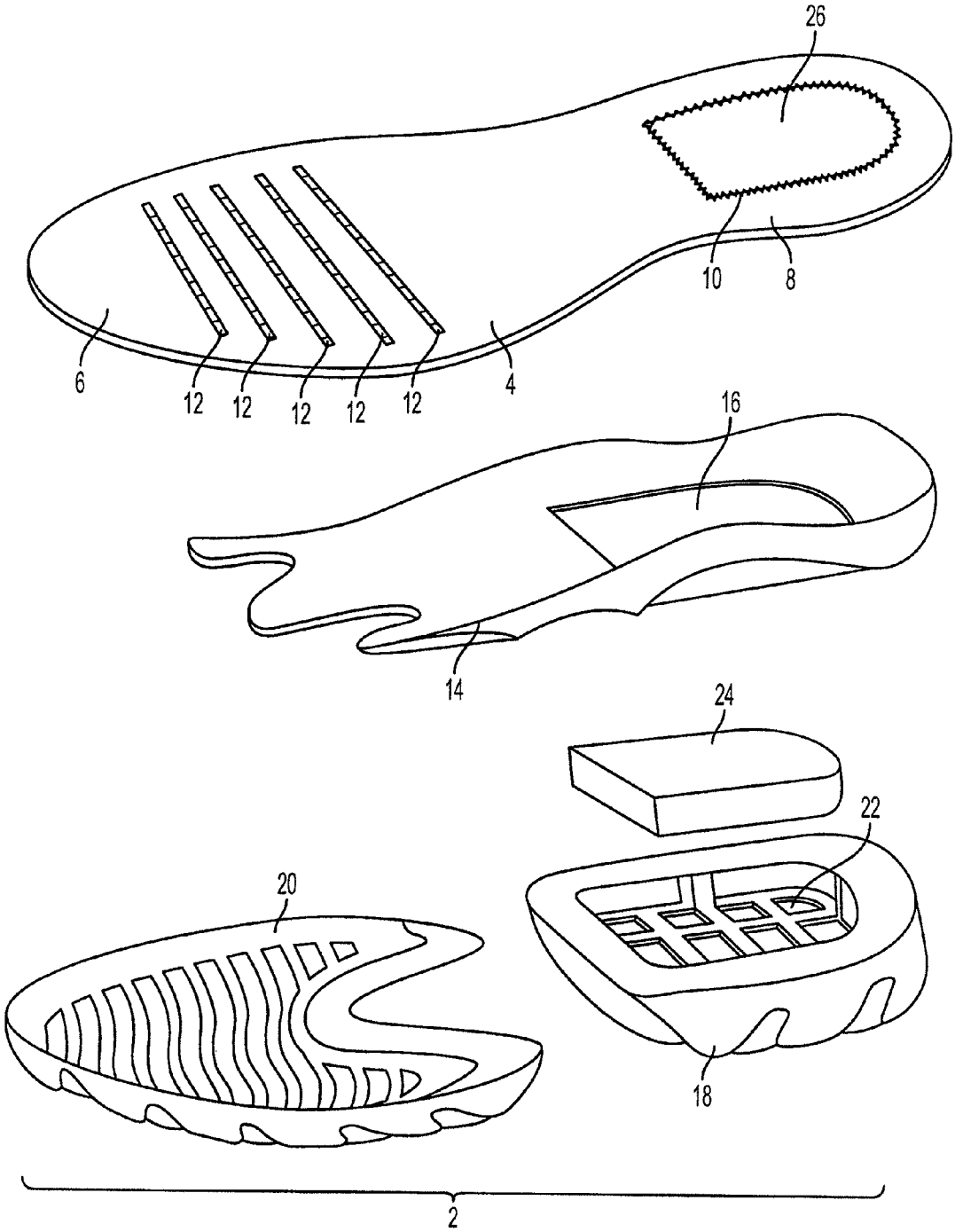
FIG. 1 is an exploded disassembled perspective view of a shoe chassis or shoe sole according to an embodiment of the present invention.

An apparatus that implement the embodiments of the various features of the present invention will now be described with reference to the drawings. The drawings and the associated descriptions are provided to illustrate embodiments of the present invention and not to limit the scope of the present invention. Reference in the specification to "one embodiment" or "an embodiment" is intended to indicate that a particular feature, structure, or characteristic described in connection with the embodiment is included in at least an embodiment of the present invention. The appearances of the phrase "in one embodiment" or "an embodiment" in various places in the specification are not necessarily all referring to the same embodiment. Throughout the drawings, reference numbers are re-used to indicate correspondence between referenced elements.

FIG. 1 is an exploded disassembled perspective view of a shoe chassis or shoe sole 2 according to an embodiment of the present invention. Shoe chassis 2 comprises a board 4, a flexible membrane 26, a cushioning material 24, a stabilizing unit 14, a first (i.e., front) pod 20, and a second (i.e., back) pod 18.

Board 4 has a first (i.e., front) end 6 and a second (i.e., back) end 8. Front end 6 can encompass an area proximate to a user's toes and back end 8 can encompass an area proximate to a user's heel. Board 4 may be made from a material such as paper, cardboard, wood, rubber, plastic, foam, leather, synthetic leather, or any combination of the above materials. Board 4 can also be constructed from any other firm, yet flexible material. Board 4 includes a first hole or opening 10 in or near second end 8 and a plurality of grooves 12 in or near first end 6. In one embodiment, plurality of grooves 12 are perforated. Plurality of grooves 12 allow board 4 to bend when shoe chassis 2 is bent in response to a movement from a user's foot. This allows for greater comfort for the user's foot and also allows the user better control of movement of shoe chassis 2.

The shape of first hole 10 is defined by the cutout in board 4. In one embodiment, first hole 10 is shaped and sized to be similar to the shape and size of a user's heel. The cutout allows the user's heel to fit within first hole 10 for better comfort and support. In FIG. 1, first hole 10 has a front side with a flat edge and a back side with a semi-circular edge. First hole 10 can be formed in the shape of a circle, an oval, a semi-circle, a square, a triangle, an ellipse, or any combination of the above shapes.

Flexible membrane 26 can cover or be positioned within first hole 10. Flexible membrane 26 allows the heel to flex past or through first hole 10 and compress cushioning material 24, which is under flexible membrane 26. As shown in FIG. 1, flexible membrane 26 is die cut and zig zag stitched to board 4. Flexible membrane 26 can also be attached to board 4 through a variety of means including, but not limited to, other types of stitching, adhesives, and/or fasteners.

In one embodiment, flexible membrane 26 is a soft, stretchable and durable cushion material or membrane such as ethylene vinyl acetate (EVA), foam, plastic, and/or rubber. Flexible membrane 26 can also be formed from any other type of flexible material. In one embodiment, flexible membrane 26 has relatively the same thickness as board 4. It is also contemplated, however, that flexible membrane 26 can be thinner or thicker than board 4.

Stabilizing unit 14 is located beneath board 4 and includes a second hole 16 located directly beneath first hole 10 of board 4. Board 4 fits within stabilizing unit 14. Stabilizing unit 14 is constructed of thermoplastic polyurethane that is injection molded. Stabilizing unit 14 can also be constructed of any other type of material that is semi-flexible such as rubber, plastic, foam, etc. Stabilizing unit 14 can be used to stabilize the heel and shank of the user. If flexible membrane 26 is thicker than board 4, it may extend into second hole 16.

Second hole 16 has a front side with a flat edge and a back side with a semi-circular edge. Second hole 16 can be formed in the shape of a circle, an oval, a semi-circle, a square, a triangle, an ellipse, or any combination of the above shapes. Second hole 16 can also have the same shape or a different shape as first hole 10.

First pod 20 and second pod 18 are located below stabilizing unit 14 to provide support for stabilizing unit 14 and board 4. First pod 20 and second pod 18 can be connected together using an arch or bridge (not shown) made of a plastic, rubber or other material. Second pod 18 includes a cutout or depression 22 located directly beneath second hole 16. First pod 20 and second pod 18 are high abrasion rubber forefoot and heel pods, respectively. First pod 20 and second pod 18 can be constructed from flexible, yet extremely durable materials such as other types of rubber, plastic, etc.

Cushioning material 24 is located within depression 22. In one embodiment, cushioning material 24 is a soft and durable cushioning material such as ethylene vinyl acetate (EVA), foam, plastic, and/or rubber. Cushioning material 24 can be formed from any other type of cushioning material. In one embodiment, cushioning material 24 can fill depression 22 such that it has the same height as second pod 18. Cushioning material 24 can protrude upward from depression 22 and partially or completely fill second hole 16.

In operation, a user places a heel of his foot onto flexible membrane 26. The heel contacts and stretches or bends flexible membrane 26 and puts pressure on flexible membrane 26. The pressure is translated from flexible membrane 26 through second hole 16 and onto cushioning material 24.

Since the force is translated from flexible membrane 26 through second hole 16 and onto cushioning material 24, there is a greater cushioning effect. That is, the force from the heel will generally be absorbed by flexible membrane 26 and then absorbed by cushioning material 24 instead of being absorbed by board 4 and/or stabilizing unit 14. This is advantageous since flexible membrane 26 and cushioning material 24 provide better cushioning than board 4 and/or stabilizing unit 14.

Furthermore, by having two holes 10 and 16, that is first hole 10, which is covered by only flexible membrane 26, and second hole 16, the user's heel has relatively direct access to cushioning material 24. Such a configuration may prevent the user's heel from sliding around board 4 and may allow the user to have better control of shoe chassis 2. This allows the user to move at a faster pace with greater comfort. This can also be beneficial when a user is using shoe chassis 2 for strenuous activities such as walking rapidly, jogging, and/or running.

The previous description of the disclosed examples is provided to enable any person of ordinary skill in the art to make or use the disclosed apparatus. Various modifications to these examples will be readily apparent to those skilled in the art, and the principles defined herein may be applied to other examples without departing from the spirit or scope of the disclosed apparatus. The described embodiments are to be considered in all respects only as illustrative and not restrictive and the scope of the present invention is, therefore, indicated by the appended claims rather than by the foregoing description. All changes which come within the meaning and range of equivalency of the claims are to be embraced within their scope.

What is claimed is:

1. A shoe chassis comprising:

a board including a first end and a second end, the board having a portion defining a hole at the second end;

a flexible membrane having a shape similar to the hole of the board, the flexible membrane configured to cover the hole of the board by being attached to the board, the flexible membrane being substantially flat;

a stabilizing unit beneath the board, the stabilizing unit having a portion defining a hole directly beneath the hole of the board;

a first pod below the stabilizing unit, the first pod including a portion defining a depression directly beneath the hole of the stabilizing unit; and a cushioning material having a shape similar to the hole, the cushioning material located within the depression of the first pod.

2. The shoe chassis of claim 1 wherein the board further includes a plurality of perforated grooves located at the first end of the board.

3. The shoe chassis of claim 1 wherein the flexible membrane is stitched to the board.

4. The shoe chassis of claim 1 wherein the flexible membrane is attached to the board via an adhesive.

5. The shoe chassis of claim 2 further comprising a second pod located adjacent to the first pod, the second pod located beneath the plurality of perforated grooves at the first end of the board.

6. The shoe chassis of claim 5 wherein the first pod and the second pod are distinctly separated.

7. The shoe chassis of claim 5 wherein the first pod and the second pod are attached by a bridge.

8. The shoe chassis of claim 2 wherein the cushioning material has a footprint size substantially the same as a footprint size of the flexible membrane.

9. The shoe chassis of claim 2 wherein the shoe chassis is configured to translate a force applied on the flexible membrane to the cushioning material without translating the force on the board and stabilizing unit.

10. A shoe chassis comprising:

a board including a first end and a second end, the board having a portion defining a hole at the second end;

a flexible layer of material configured to cover the hole of the board by being stitched to the board, the flexible layer of material being substantially flat;

a stabilizing unit beneath the board, the stabilizing unit having a portion defining a hole directly beneath the hole of the board;

a pod below the stabilizing unit, the pod including a portion defining a depression directly beneath the hole of the stabilizing unit; and a depression filler located within the depression of the first pod, the depression filler being a cushion.

11. The shoe chassis of claim 10 wherein the flexible layer of material is die cut and stitched to the board with a zig zag pattern.

12. The shoe chassis of claim 10 wherein the flexible layer of material is thicker than a thickness of the board and extends into the hole of the stabilizing unit.

13. The shoe chassis of claim 10 wherein the flexible layer of material does not extend into the hole of the stabilizing unit.

14. The shoe chassis of claim 10 wherein the flexible layer of material is ethylene vinyl acetate.

15. The shoe chassis of claim 10 wherein the flexible layer of material is foam.

16. The shoe chassis of claim 10 wherein the flexible layer of material is plastic.

17. The shoe chassis of claim 10 wherein the flexible layer of material is rubber.

18. A shoe chassis comprising:

a toe pod;

a heel pod, separate from the toe pod, the heel pod having a top surface and enclosed walls surrounding the top surface forming a cavity, the heel pod further having a bottom surface for contacting a ground surface, the top surface of the heel pod and the bottom surface of the heel pod being substantially parallel;

a heel cushion sized to fit within the heel pod and having a top surface and a bottom surface substantially parallel to the top surface, the bottom surface of the heel cushion contacting the bottom surface of the heel pod; and a board having a substantially uniform thickness, the board including a first end configured to support a plurality of toes of a foot, and a second end configured to support a heel of a foot, the board contacting the top surface of the heel cushion.

19. The shoe chassis of claim 18 wherein the board is constructed out of a rigid, non-flexible material.

* * * * *